US009933232B2

(12) United States Patent
Gilmer

(10) Patent No.: US 9,933,232 B2
(45) Date of Patent: Apr. 3, 2018

(54) HANDGUN SUPPORT DEVICE

(71) Applicant: Robert L. Gilmer, Reno, NV (US)

(72) Inventor: Robert L. Gilmer, Reno, NV (US)

( * ) Notice: Subject to any disclaimer, the term of this patent is extended or adjusted under 35 U.S.C. 154(b) by 0 days.

(21) Appl. No.: 15/269,915

(22) Filed: Sep. 19, 2016

(65) Prior Publication Data

US 2017/0082393 A1 Mar. 23, 2017

Related U.S. Application Data

(60) Provisional application No. 62/221,543, filed on Sep. 21, 2015.

(51) Int. Cl.

| | |
|---|---|
| ***F41C 23/12*** | (2006.01) |
| ***F41C 3/14*** | (2006.01) |
| ***F41C 23/22*** | (2006.01) |
| ***F41C 27/00*** | (2006.01) |
| ***F41C 23/10*** | (2006.01) |

(52) U.S. Cl.

CPC ..... *F41C 23/12* (2013.01); *F41C 3/14* (2013.01); *F41C 23/10* (2013.01); *F41C 23/22* (2013.01); *F41C 27/00* (2013.01)

(58) Field of Classification Search

CPC ..... F41C 23/06; F41C 23/10; F41C 23/12; F41C 23/14; F41C 27/22

USPC ..... 42/71.01, 72

See application file for complete search history.

(56) References Cited

U.S. PATENT DOCUMENTS

| | | | | | |
|---|---|---|---|---|---|
| 22,626 | A | * | 1/1859 | Colt | F41C 23/12 42/72 |
| 28,433 | A | * | 5/1860 | Alsop | F41C 23/12 42/72 |
| 1,877,016 | A | * | 9/1932 | Munson | F41C 23/12 15/104.165 |
| 3,609,902 | A | * | 10/1971 | Casull | F41C 23/12 42/62 |
| 3,685,194 | A | * | 8/1972 | Coon | F41C 23/12 42/72 |
| 3,861,273 | A | * | 1/1975 | Seidel | F41A 9/62 42/72 |

(Continued)

FOREIGN PATENT DOCUMENTS

| | | | |
|---|---|---|---|
| AT | 514689 B1 | | 3/2015 |
| WO | WO2015/161334 | * | 10/2015 |

OTHER PUBLICATIONS

European Search Report from European Application No. 16189610.5-1655, dated Jan. 24, 2017.

*Primary Examiner* — Joshua E Freeman
(74) *Attorney, Agent, or Firm* — Zilka-Kotab, PC

(57) ABSTRACT

A handgun support device includes a handgun rest for supporting at least a portion of a grip of a handgun therein, where the handgun rest includes a wall portion, and a back support for at least a portion of a back side of the grip of the handgun, the back support protruding from a back side of the wall portion and including a hole or gap to allow a thumb of a user to be placed through an opening thereof to support the handgun against the wall portion of the handgun rest with the user's fingers and opposing thumb. The handgun rest further excludes a front support for at least a portion of a front side of the grip of the handgun. Still yet, the handgun support device includes a rigid structure extending from the handgun rest for being held against an external support.

8 Claims, 4 Drawing Sheets

(56) References Cited

U.S. PATENT DOCUMENTS

| | | | | |
|---|---|---|---|---|
| 4,989,358 | A * | 2/1991 | Aronson | F41C 23/12 42/72 |
| 8,438,771 | B1 * | 5/2013 | Boone | F41C 23/12 42/72 |
| 9,631,893 | B2 | 4/2017 | Gilmer | |
| 2009/0282718 | A1 * | 11/2009 | Bartley | F41C 23/12 42/75.03 |
| 2015/0068097 | A1 * | 3/2015 | DenBleyker | F41C 23/12 42/94 |
| 2017/0045330 | A1 * | 2/2017 | Bubits | F41C 23/12 |

* cited by examiner

HANDGUN SUPPORT DEVICE

CLAIM FOR PRIORITY

This application claims the benefit of U.S. Provisional Application No. 62/221,543, filed Sep. 21, 2015, the entire contents of which are incorporated herein by reference.

FIELD OF THE INVENTION

The present invention relates to handguns, and more particularly to handgun support systems.

BACKGROUND

Conventional handgun designs inherently cause threat to the users of such handguns, particularly upon firing. For example, when a semi automatic handgun is fired, the handgun slide is blown back by the explosion of the ammunition. Any finger, face, or eye near a semi automatic handgun slide during firing is in danger of being seriously injured. As another example, when a revolver handgun is fired the explosive gases escape from the front of the revolver's cylinder and the revolver's barrel. Any finger near the front of the revolver's cylinder during firing is in danger of being seriously injured.

Moreover, while in many cases the purpose of a handgun is defensive (i.e. to prevent life from being taken), conventional handgun designs do not inherently help prevent inadvertent damage to third parties upon firing. For example, shot placement accuracy is critical when dealing with life threatening situations. Poor shot placement can cause failure to protect life, and poor shot placement can cause innocent life to be taken. Thus, every round fired from a handgun has the potential of causing death or serious injury.

While existing handgun add-ons have been introduced to alleviate at least some of the above issues inherent with handguns, these handgun add-ons have exhibited various limitations. For example, existing handgun add-ons have physically attached to the handgun, therefore changing the basic operation of the handgun.

There is thus a need for addressing these and/or other issues associated with the prior art.

SUMMARY

A handgun support device is provided. The handgun support device includes a handgun rest for supporting at least a portion of a grip of a handgun therein, where the handgun rest includes a wall portion, and a back support for at least a portion of a back side of the grip of the handgun, the back support protruding from a back side of the wall portion and including a hole or gap to allow a thumb of a user to be placed through an opening thereof to support the handgun against the wall portion of the handgun rest with the user's fingers and opposing thumb. The handgun rest further excludes a front support for at least a portion of a front side of the grip of the handgun which allows the user's fingers to make direct contact with the front side of the grip of the handgun when using the handgun support device to grip the handgun. Still yet, the handgun support device includes a rigid structure extending from the handgun rest for being held against an external support.

DETAILED DESCRIPTION

Figure 1:
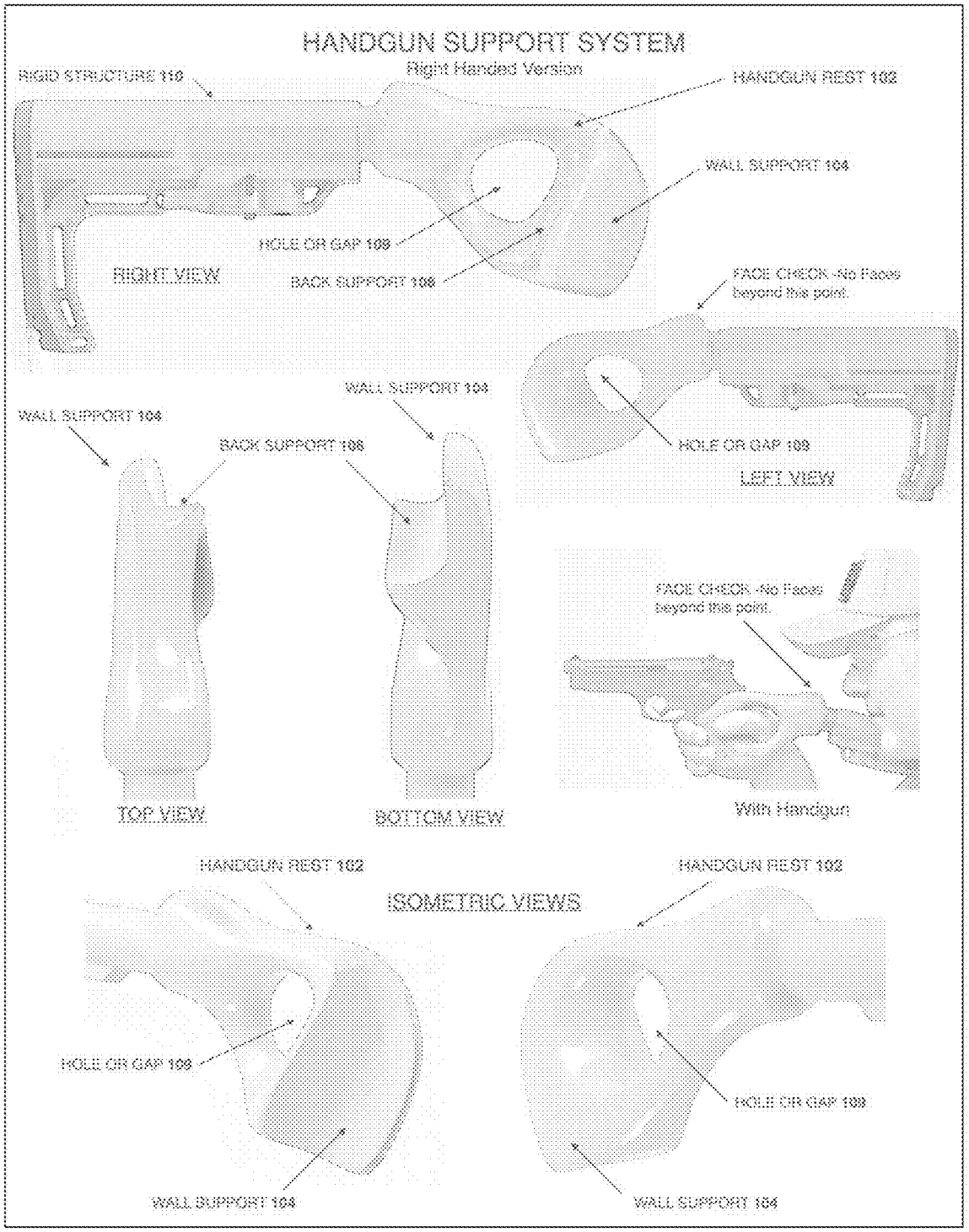
FIG. 1 illustrates various views of a handgun support device having a single wall portion, in accordance with one embodiment.

FIG. 1 illustrates various views of a handgun support device having a single wall portion, in accordance with one embodiment. The handgun support device may be formed with, at the very least, the features described below with reference to FIG. 1. Of course, additional features may also be included, such as those described below with reference to the subsequent figures.

The handgun support device may be a solid formed device, or any of the various features of the handgun support device may be separately formed and attached to form the handgun support device. In various embodiments, the handgun support device may be formed, using either singularly or using any combination of hardwoods, metals, polymers, natural fibers, synthetic fibers, ceramics, and composite materials.

For example, the handgun support device may be manufactured by injection molding, machining, stamping, deep forming, thermal vacuum molding, casting, drawing, forging, over molding, rotational molding, reaction injection molding, printing on a three-dimensional (3D) printer, etc.

As shown, the handgun support device includes a handgun rest 102 for supporting at least a portion of a grip of a handgun therein. For example, a user of the handgun may hold the handgun in a standard manner, but with the portion of the grip of the handgun against the handgun rest 102. The handgun may be a semi automatic handgun, revolver, or any other type of handgun.

Since the handgun support device includes the handgun rest 102 for supporting at least a portion of a grip of a handgun therein, the handgun support device may be formed for a particular make and/or model of handgun (e.g. through the molding, etc. processes mentioned above). For example, different handgun support devices may be formed for different handgun makes and/or models. This may allow the portion of the grip of the handgun held by the handgun rest 102 to rest flush against the handgun rest 102 of the handgun support device. To this end, the handgun rest 102 may be a groove or other indentation in which the portion of the grip of the handgun is held (e.g. placed, situated, etc.).

The handgun rest 102 may be formed such that the portion of the grip of the handgun may be placed therein without necessarily being attached thereto, or locked therein, by any further mechanism. In particular, the handgun rest 102 rest includes a wall portion 104 that supports a lateral side of the grip of the handgun. The wall portion 104 may optionally be solid and/or flat. The wall portion 104 may be utilized such that the lateral side of the portion of the grip of the handgun rests against the wall portion 104 when the portion of the grip of the handgun is held by the user against the handgun rest 102. To this end, the wall portion 104 may be of sufficient size and strength to support a user's hand supporting the portion of the grip of the handgun against the wall portion 104.

The handgun rest 102 rest further includes a back support 106 for at least a portion of a back side of the grip of the handgun, where the back support 106 protrudes from a back side of the wall portion 104. The back support 106 includes a hole or gap 109 to allow the thumb of the user to be placed through an opening thereof to support the handgun against the wall portion 106 of the handgun rest 102 with the user's fingers and opposing thumb. The back support 106 may be of sufficient size and strength to prevent the back of portion of the grip of the handgun from moving, sliding, etc. backwards when held against the wall portion 104. In one embodiment, the back support 106 may be located on the wall portion 104 in a position such that when the handgun (i.e. a semi automatic handgun in this embodiment) is held by the handgun rest 102, the back support 106 is located just under the slide of the handgun. In another embodiment, the back support 106 may be located on the wall portion 104 in a position such that when the handgun (i.e. a revolver in this embodiment) is held by the handgun rest 102, the back support 106 is located just under the hammer of the handgun. This back support 106 may improve recoil management.

As also shown, the handgun rest 102 excludes a front support for at least a portion of a front side of the grip of the handgun, which allows the user's fingers to make direct contact with the front side of the grip of the handgun when using the handgun support device to grip the handgun. This is in contrast to the handgun support device disclosed in U.S. patent application Ser. No. 14/836,861, filed Aug. 26, 2015 to Robert L. Gilmer, which requires a front support for at least a portion of a front side of the grip of the handgun and which prevents the user's hand from making direct contact with the front side of the grip of the handgun when using the handgun support device to grip the handgun.

Thus, the handgun rest 102 disclosed in the present embodiment has having the wall portion 104 and back support 106 forms a platform against which a side and back of the portion of the grip of the handgun rests flush. This provides a type of bench rest for the portion of the grip of the handgun, when held by a user.

Moreover, as shown, the handgun support device further includes a rigid structure 110 extending from the handgun rest 102 for being held against an external support. For example, the external support may be a portion of the body of the user of the handgun (e.g. a shoulder, torso, leg, wrist, etc.). The rigid structure 110 may be of sufficient length to reach the body of the user when the handgun is held at least partially at arm's length by the user. In various embodiments, the rigid structure 110 may be an attachment to the handgun rest 102, such as a metal frame, composite thin frame, folding frame or hard case attached to the handgun rest 102.

To use the handgun support device, in one embodiment, a user needs simply to support the rigid structure 110 against the user's upper torso with the user's opposing hand, place the handgun within the handgun rest 102, and fire the handgun. The rigid structure 110 can provide a cheek rest to take aim from a repeatable position and improve shot placement accuracy.

More illustrative information will now be set forth regarding various optional architectures and uses in which the foregoing method may or may not be implemented, per the desires of the user. It should be strongly noted that the following information is set forth for illustrative purposes and should not be construed as limiting in any manner. Any of the following features may be optionally incorporated with or without the exclusion of other features described.

Figure 2:
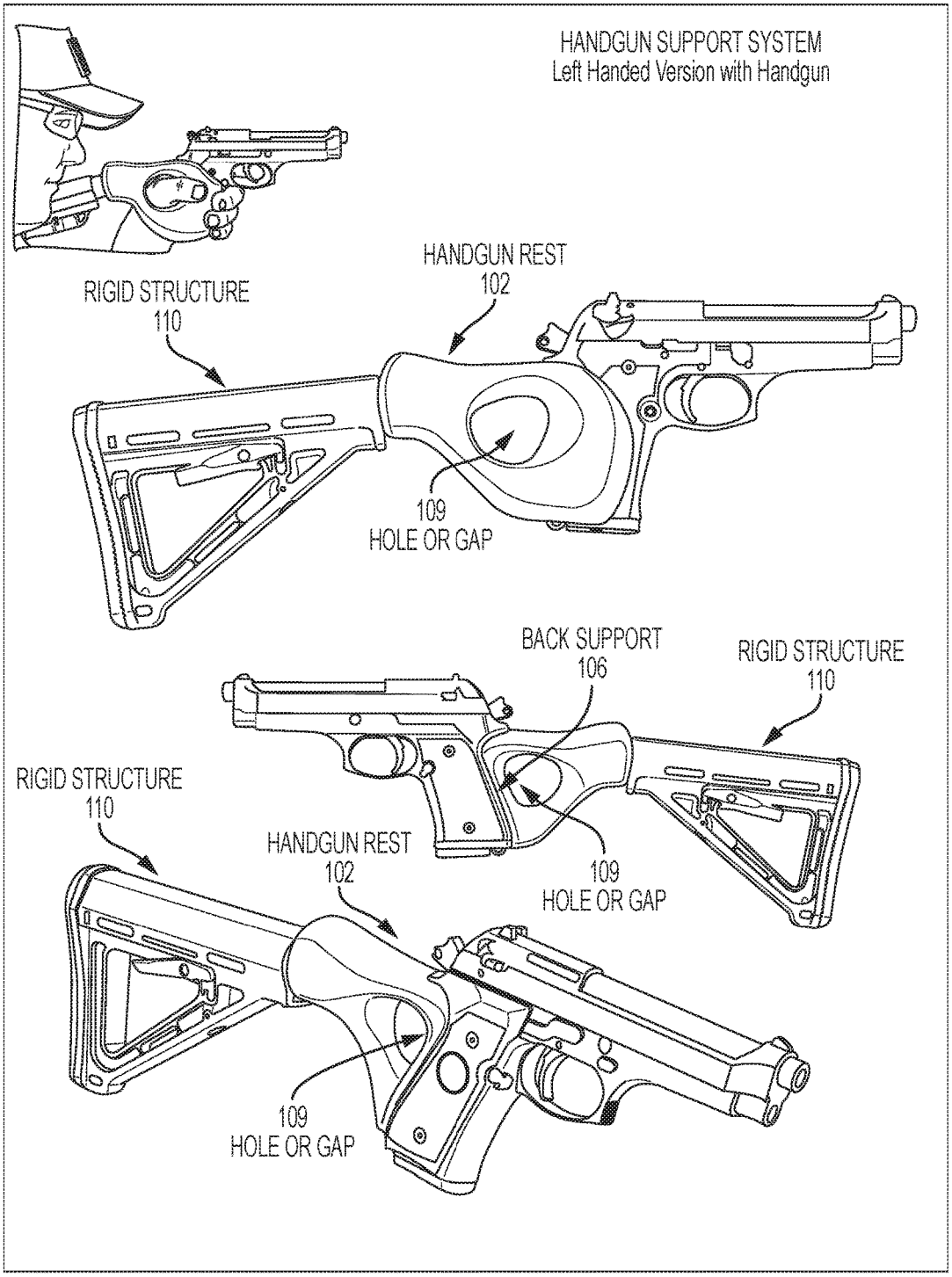
FIG. 2 illustrates various views of a handgun support device having an extending rigid structure, in accordance with a possible further embodiment of FIG. 1.

FIG. 2 illustrates various views of a handgun support device having an extending rigid structure, in accordance with a possible further embodiment of FIG. 1. The extending rigid structure may be an Adjustable Rest Extension (MIL-SPEC). When the handgun support device is in use, the rigid structure 110 is held against an external support (e.g. a portion of the body of the user of the handgun. As shown, the handgun support device may be utilized such that a face of the user is not to be placed beyond the rigid structure 110 at a point where the handgun rest 102 attaches to the rigid structure 110.

Figure 3:
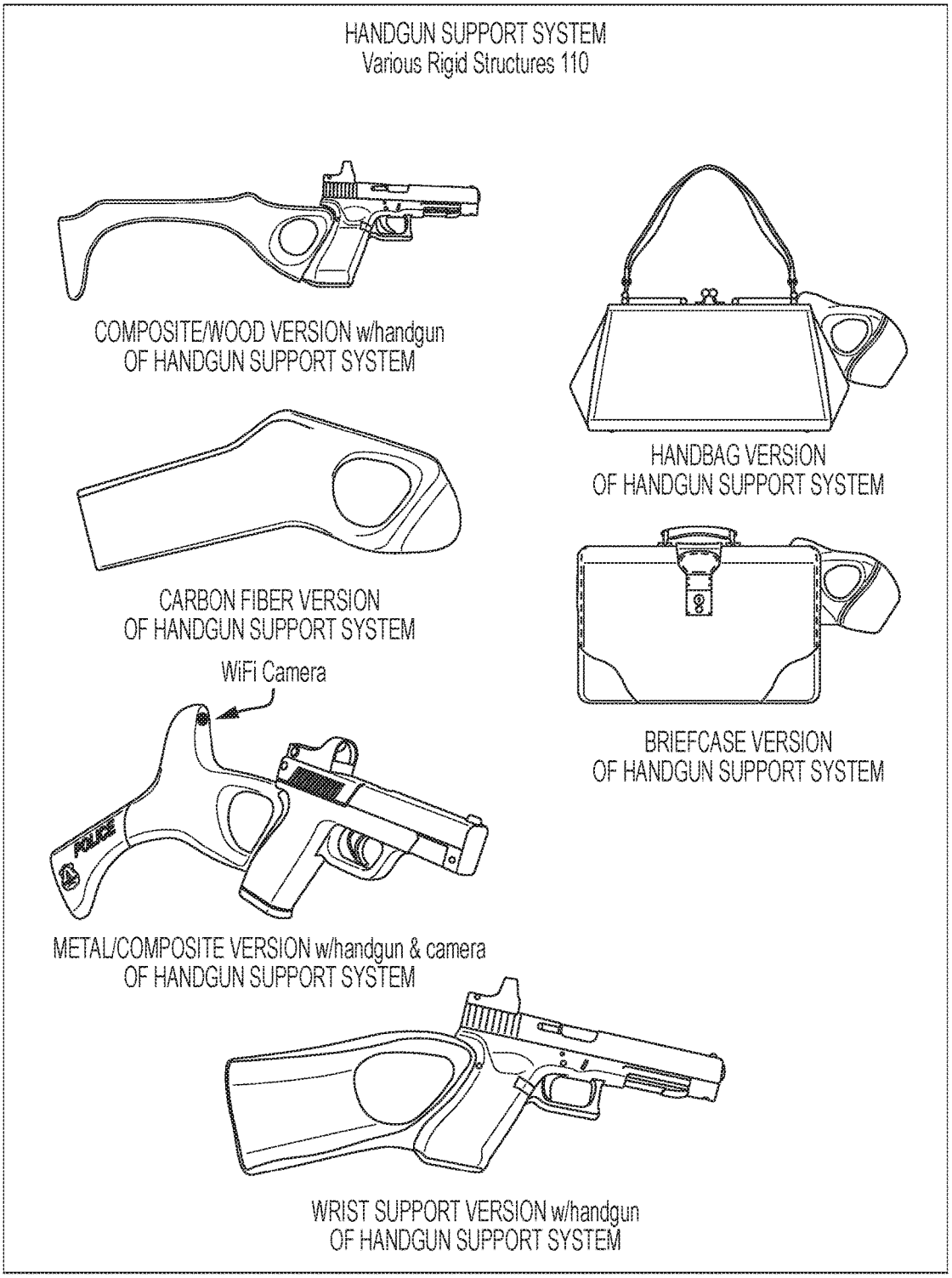
FIG. 3 illustrates various possible rigid structures for a handgun support device, in accordance with still yet other embodiments.

FIG. 3 illustrates various possible rigid structures for a handgun support device, in accordance with still yet other embodiments. These exemplary rigid structures are shown as extensions to a handgun support rest having a single wall, as disclosed with respect to FIG. 1. The rigid structures shown include a wood/composite material, a handbag-like configuration having well-known handbag-like materials, a carbon fiber material, a briefcase-like configuration having well-known briefcase-like materials, and a metal/composite material.

Figure 4:
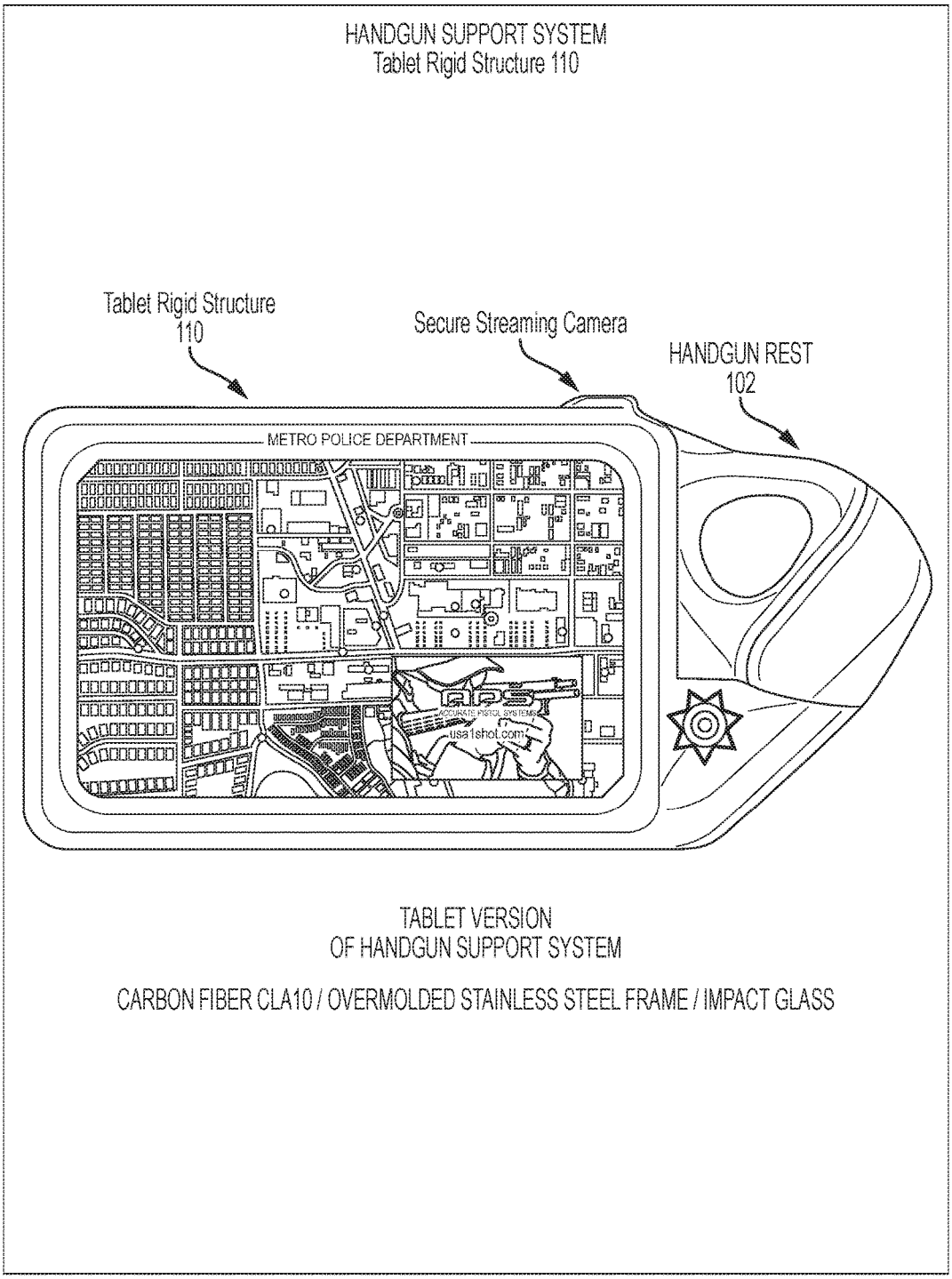
FIG. 4 illustrates a tablet integrated in a rigid structure for a handgun support device, in accordance with yet a further embodiment.

FIG. 4 illustrates a tablet integrated in a rigid structure for a handgun support device, in accordance with yet a further embodiment. The tablet may be any well-known tablet computer. As shown, handgun support device may, in conjunction with or alternatively to the tablet, be integrated with a secure streaming camera, either by being included within the handgun rest 102 and/or the rigid structure 110. The camera may provide secure remote viewing and recording of the handgun operation.

While various embodiments have been described above, it should be understood that they have been presented by way of example only, and not limitation. Thus, the breadth and scope of a preferred embodiment should not be limited by any of the above-described exemplary embodiments, but should be defined only in accordance with the following claims and their equivalents.

What is claimed is:

1. A device, comprising:

a handgun rest for supporting at least a portion of a grip of a handgun therein, the handgun rest including:

a first wall portion that supports a first lateral side of the grip of the handgun, and a back support for at least a portion of a back side of the grip of the handgun, the back support protruding from a back side of the first wall portion and including a hole or gap to allow a thumb of a user to be placed through an opening thereof to support the handgun against the first wall portion of the handgun rest with the user's fingers and opposing thumb such that the grip of the handgun is held in the handgun rest from the support of the user and without being attached; and a rigid structure extending from the handgun rest for being held against an external support;

wherein the handgun rest excludes a front support for at least a portion of a front side of the grip of the handgun which allows the user's fingers to make direct contact with the front side of the grip of the handgun when using the handgun support device to grip the handgun;

wherein the handgun rest excludes a second wall portion for an entire second lateral side of the grip of the handgun which allows the user's hand to make direct contact with the second lateral side of the grip of the handgun when using the handgun support device to grip the handgun.

2. The device of claim 1, wherein the handgun rest is shaped specific to a particular model of the handgun.

3. The device of claim 2, wherein the handgun rest is manufactured by a molding process to be shaped specific to the particular model of the handgun.

4. The device of claim 1, wherein the back support is flush with an entirety of the back side of the grip of the handgun when the grip of the handgun is being supported by the handgun rest.

5. The device of claim 4, wherein when the handgun is a semi automatic handgun, the back support is located just under a slide of the handgun.

6. The device of claim 4, wherein when the handgun is a revolver, the back support is located just under a hammer of the handgun.

7. The device of claim 1, wherein the handgun rest is an indentation in which at least a portion of the grip of the handgun is capable of being held by the user.

8. The device of claim 1, wherein the external support is a portion of the body of the user of the handgun.

* * * * *